United States Patent [19]

Lai

[11] 4,305,543

[45] Dec. 15, 1981

[54] CARDBOARD TRAYS

[76] Inventor: Tsu-Yu Lai, 251-18, Section 2, Si Tung Rd., Taichung, Taiwan

[21] Appl. No.: 117,579

[22] Filed: Feb. 1, 1980

[51] Int. Cl.[3] ..... B65D 5/26; B65D 5/36; B65D 5/24

[52] U.S. Cl. ..... 229/32

[58] Field of Search ..... 229/32, 34

[56] References Cited

U.S. PATENT DOCUMENTS

| | | | |
|---|---|---|---|
| 781,766 | 2/1905 | Cawthray | 229/32 |
| 1,373,365 | 3/1921 | Smouse | 229/32 |
| 2,043,104 | 6/1936 | Labombarde | 229/32 X |
| 2,157,686 | 5/1939 | Ballard | 229/34 X |
| 2,751,138 | 6/1956 | Laver | 229/32 |
| 2,753,103 | 7/1956 | Van Rosen et al. | 229/34 R |
| 3,381,878 | 5/1968 | Dewhurst | 229/34 R |
| 3,685,718 | 8/1972 | Chidgey | 229/34 R |

FOREIGN PATENT DOCUMENTS

| | | | |
|---|---|---|---|
| 408764 | 9/1966 | Switzerland | 229/32 |
| 562134 | 5/1975 | Switzerland | 229/32 |
| 1249884 | 10/1971 | United Kingdom | 229/32 |

*Primary Examiner*—Davis T. Moorhead

*Attorney, Agent, or Firm*—Shoemaker and Mattare, Ltd.

[57] ABSTRACT

An improved construction for cardboard trays made from a single cardboard blank, in which the side panels are held in position by tabs formed around the outer corners of one of two adjacent side panels, where the tabs are folded over to enfold the edge or edges of the neighboring side panel having flaps formed on and folded inwardly therefrom.

2 Claims, 21 Drawing Figures

CARDBOARD TRAYS

DESCRIPTION OF PRIOR ART

As of this date the applicant is not aware of any prior art that is obvious or relevant to the present invention. The known practice of making a cardboard tray from a cardboard blank is that two adjacent side panels are bonded together by means of adhesives or stitched together by means of staplers and the like. Such methods not only require added material but also require tools and equipment; extra cost is thus incurred when making a tray from the blank.

BRIEF DESCRIPTION OF THE INVENTION

The present invention relates to improvements in cardboard tray construction and more particularly to cardboard trays which are made from single blanks without need of bonding or stitching.

A cardboard tray according to the present invention is made from a single blank having tab or tabs on one of two adjacent side panels; the tabs, when the tray is made, are folded along scored lines formed along the edge or the edges or the extension of the edges of the side panels, over the edge or edges of the neighboring side panels having end flanges folded inwardly to hold the two adjacent side panels together in position.

Therefore, it is the main object of the present invention to provide a novel cardboard tray construction in which a tray can be made from a single cardboard blank without the need of additional material and equipment.

DETAILED DESCRIPTION OF THE INVENTION

The details, advantages and the object of the present invention will be apparent from the following description taken in conjunction with the accompanying drawings, in which.

Figure 1A:
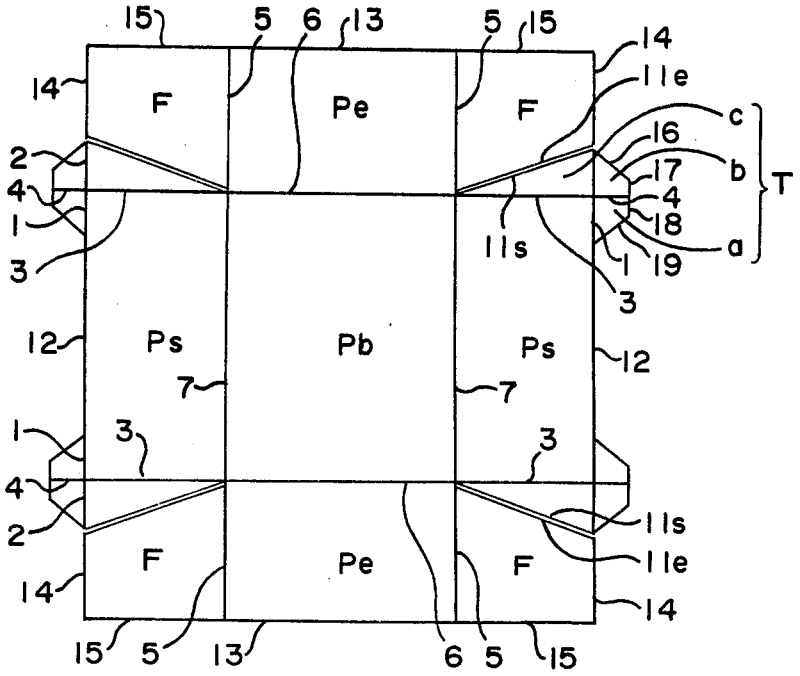
FIG. 1A is a plan view of the cardboard blank of the first embodiment of the present invention.

Referring now to FIG. 1A, the cardboard blank of the first embodiment comprises a bottom panel Pb, whose shape, by way of example, is rectangular, a pair of side panels Pe having flaps F, and a pair of side panels Ps having tabs T.

The bottom panel Pb is defined by the score lines 6, 6, 7, 7, along which the side panels Pe, Pe, Ps, Ps are to be folded upwardly; the side panel Pe is defined by the score line 5, 5, 6 and the edge 13; the flap F is defined by the score line 5, edges 14, 15 and the edge 11*e*. The side panel Ps is defined by the score lines 1, 3, 7, 3, 1 and the edge 12; the tab T is defined by the score lines 3, 1 and the edges 11*s*, 16, 17, 18, 19 and is divided by the score lines 2, 4 into three sections a, b, c defined by the score lines 1, 4 and the edges 18, 19, the score lines 4, 2 and the edges 17, 16 and the score lines 3, 2 and the edge 11*s* respectively.

It is to be noted that the score lines 1 and 2 are essentially in the same straight line as edge 12, and the score line 4 is an extension of score line 3.

It is also to be noted that the edge 15 of the flap F is essentially an extension of edge 13.

It is yet to be noted that the height of the side panel Pe defined by the length of the score line 5 is essentially the same as that of the side panel Ps defined by the length of the score line 3.

Figure 1B:
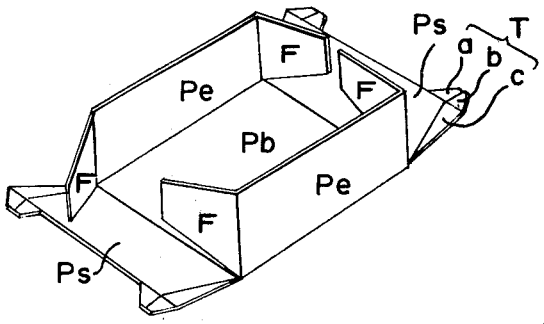
FIG. 1B is an oblique, perspective view of a cardboard tray in the process of being folded from the blank as shown in FIG. 1A.
Figure 1C:
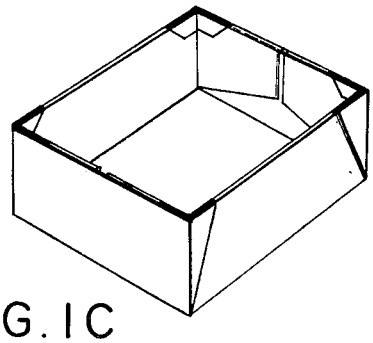
FIG. 1C is an oblique, perspective view of a completed cardboard tray made from the blank as shown in FIG. 1A.

To make a cardboard tray of the first embodiment from the blank described above, first fold the side panels Pe upwardly and fold the flaps F inwardly along the score lines 6 and 5 respectively, as shown in FIG. 1B. With the side panels Pe folded 90 degrees upward and the flaps F folded 90 degrees inward, fold the side panels Ps upwardly to overlap with the flaps F, thus the score lines 1 are flush with the edges 15 and the score lines 3 coincide with the score lines 5. Then fold the sections b and c 90 degrees inward along the score lines 3 and 4, and then fold the sections a and b along the score lines 1 and 2 respectively over the edges 15 and 13 inwardly and downwardly to enfold the end portions of the edges 15 and 13 respectively. In the process of folding the sections a and b the sections a and b may be resiliently warped to facilitate the folding process.

The tabs T folded as described are thus inter-engaged with the flabs F and the side panels Pe, holding two adjacent panels Pe and Ps together firmly at 90 degrees, and the tray as folded is ready for use.

Figure 2A:
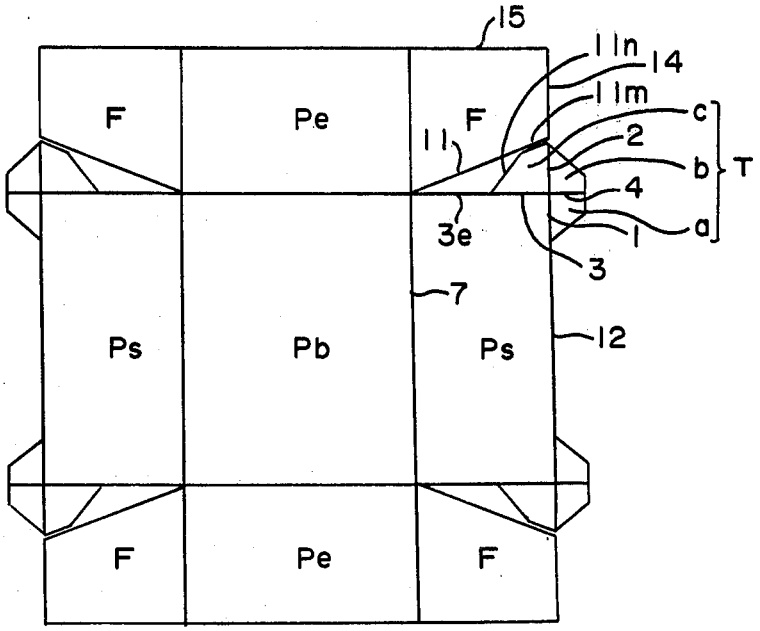
FIGS. 2A, 2B and 2C are views of the second embodiment in various states as in FIGS. 1A, 1B and 1C respectively.
Figure 2B:
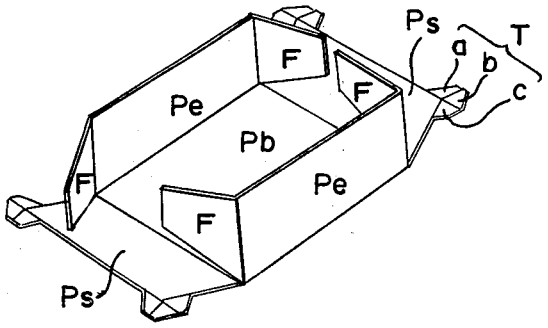
Figure 2C:
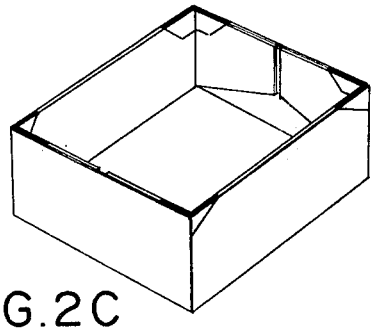

The second embodiment shown in FIGS. 2A, 2B and 2C is similar to the first embodiment except that the second embodiment is characterized by the shorter section C of the tab T, which is defined by the edges 11*m*, 11*n*, score lines 2, 3, giving the edge 3*e* of the side panels Ps to coincide with the score line 5 when the tray is made. Thus the sections C left outside of the tray may be concealed with a cover having side panels of relatively greater height, leaving no extra lines to mar the appearance of the side panels.

Figure 3A:
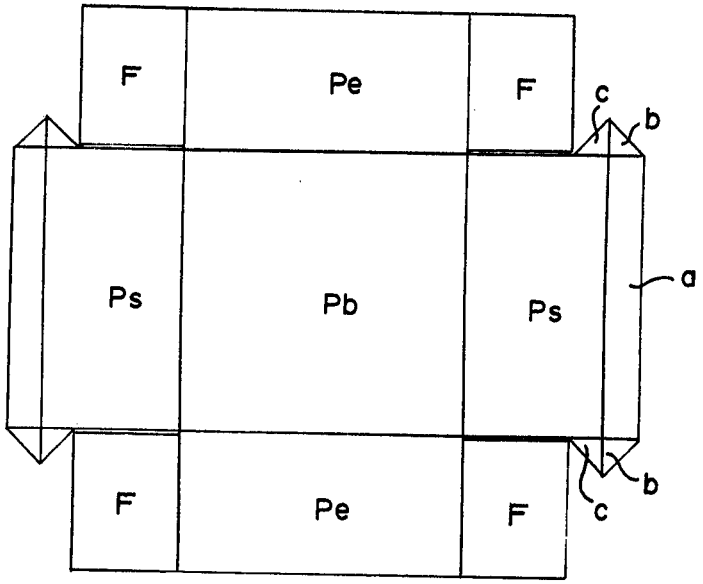
FIGS. 3A, 3B and 3C are views of the third embodiment in various states as in FIGS. 1A, 1B and 1C respectively.
Figure 3B:
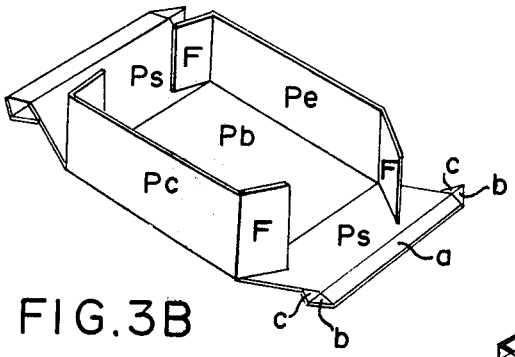
Figure 3C:
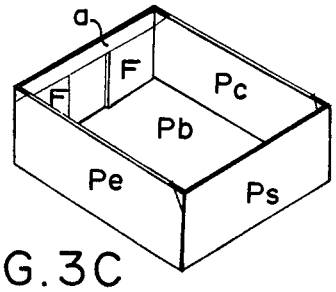

The third embodiment, shown in FIGS. 3A, 3B and 3C, offers a modified construction of the section a in the first embodiment. In this arrangement, the section a of the tab T of FIG. 1A is extended along the edge 12 of the side panel Ps to merge with that on the opposite end of the same side panel Ps, and an elongated, common section a of the tab T is formed. This arrangement reinforces the tray when folded.

Figure 4A:
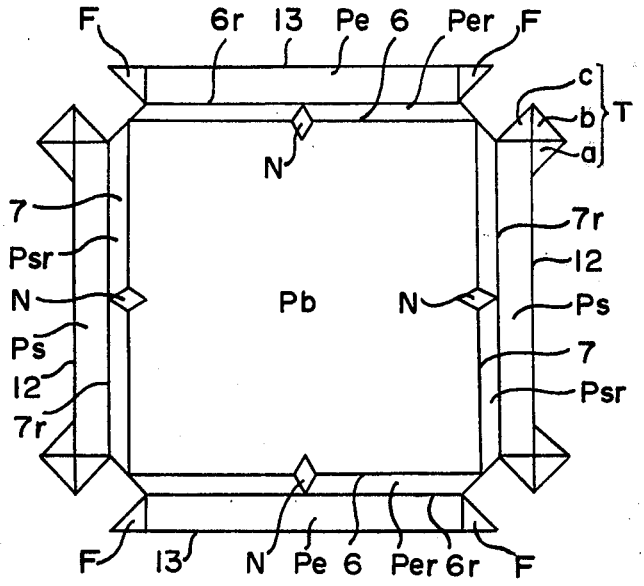
FIGS. 4A, 4B and 4C are views of the fourth embodiment in various states as in FIGS. 1A, 1B and 1C respectively.
Figure 4B:
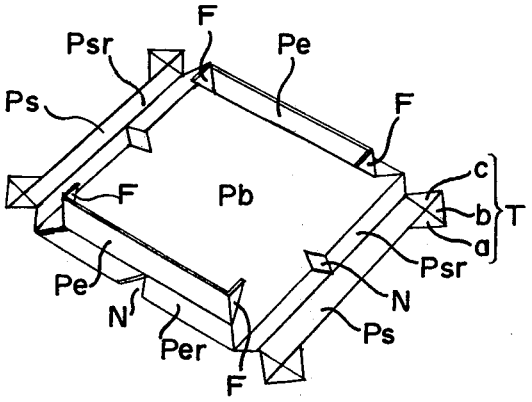
Figure 4C:
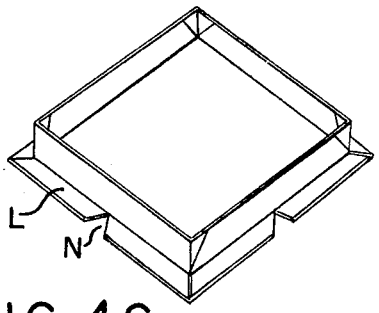

The fourth embodiment, shown in FIGS. 4A, 4B and 4C illustrates a tray of relatively lower side panels. This embodiment is characterized by the formation of interim panels Per, Pes between the side panels Pe, Ps and the bottom panel Pb. The interim panels Per, Psr, are formed by the addition of the new score lines 6*r*, 7*r* parallel to the score line 6, 7 with a suitable distance equivalent to that of the flange to be formed along the edges of the bottom panel Pb. A diamond shaped aperture N is formed at the mid point of each of the score lines 6, 7 to become a notch when the tray is folded. Said apertures, though a diamond shape is shown, can be rectangular or circular in shape. The ends of the interim panels Per, Psr are trimed 45 degrees so that the ends of the two neighboring interim panels do not overlap each other when the tray is made. The formation of the side panels Pe and the flaps F and the side panels Ps and tabs T is the same as the first embodiment except that the score lines 6, 6, 7, 7, along which the side panels in the first embodiment are to be folded become lines 6*r*, 6*r*, 7*r*, 7*r* in this embodiment.

To make a tray of this embodiment from the blank, first fold the interim panels Per together with the side panels Pe along the score lines 6 180 degrees inwardly, and then fold the side panels Pe along the score lines 6*r* 90 degrees upwardly, and fold the flaps F along the score lines 5 90 degrees inwardly. Then proceed to fold the interim panels Psr and the side panels Ps in the same manner. At this point the end portions of the side panels Ps overlap the flaps F which have been folded parallel to the side panels Ps, and the score lines 3 meet the score lines 5 as in the first embodiment. Then proceed to fold the tabs T as in the first embodiment to complete the tray.

The tray of this embodiment when completed has a flange L formed on each side along the edge of the bottom panel extending beyond the side panels, as shown in FIG. 4C. Because the flange L is composed of two layers of the cardboard, it reinforces the tray. The presence of the flange L as described also enables the use of a cover of greater height to ride thereon when the contact of the cover top with the content of the tray, such as a birthday cake for example, is undesirable.

The notch N formed on the mid position of the flange on each side of the tray is for positioning string or lace to facilitate wrapping and carrying.

Figure 5A:
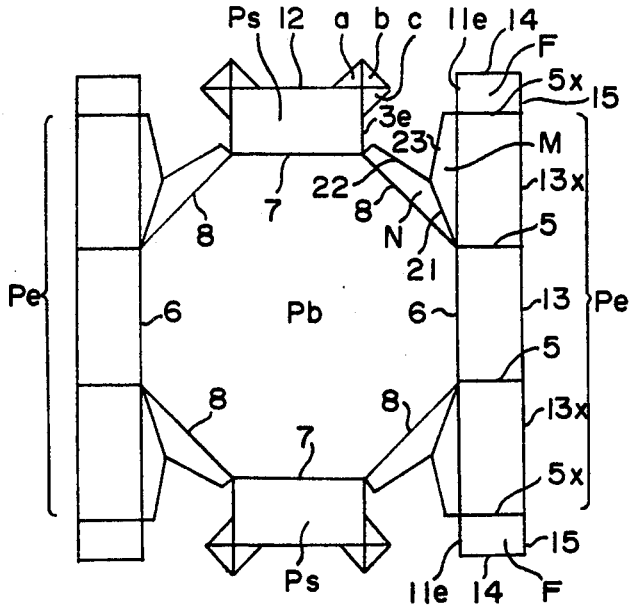
FIGS. 5A, 5B and 5C are views of the fifth embodiment in various states as in FIGS. 1A, 1B and 1C respectively.
Figure 5B:
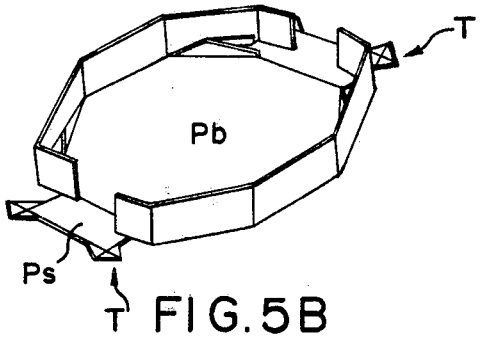
Figure 5C:
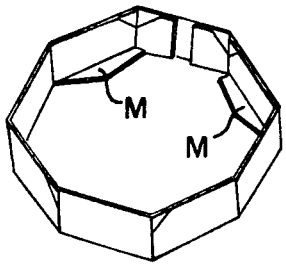

FIGS. 5A 5B and 5C show a tray of octagonal shape as a fifth embodiment of the present invention. As shown in FIG. 5A, the bottom panel Pb is defined by the score lines 6, 8, 7, 8, 6, 8, 7, 8, and the side panel Pe is defined by the edges 13*x*, 13, 13*x* and the score lines 5*x*, 6*x*, 6, 6*x*, 5*x* with flaps F at both ends. Two connecting flaps M and N are provided between each score line 8 of the bottom panel Pb and each score line 6 of the side panels Pe and are formed with a score line 21 therebetween.

The formation of the side panels Ps is the same as in the second embodiment except that sections a and b in this embodiment are smaller and trianglar in shape.

To make the tray of this embodiment, first fold the side panels Pe along the score lines 6 90 degrees upward, second fold the end portions of the side panels Pe along the score lines 5 inwardly to make the score lines 6 to coincide with the score lines 8. In this process the connecting flaps M and N are folded together inwardly along the score line 21 to overlap each other and lie flat on the bottom panel Pb. Then fold the flaps F along the score lines 5*x* inwardly to make the edges of the flaps meet the score lines 7. Next, fold the side panels Ps upwardly along the score lines 7, and fold the tabs T inwardly to enfold the end portions of edges 15 and 13*x*, as in the second embodiment, to complete the tray for use.

Figure 6A:
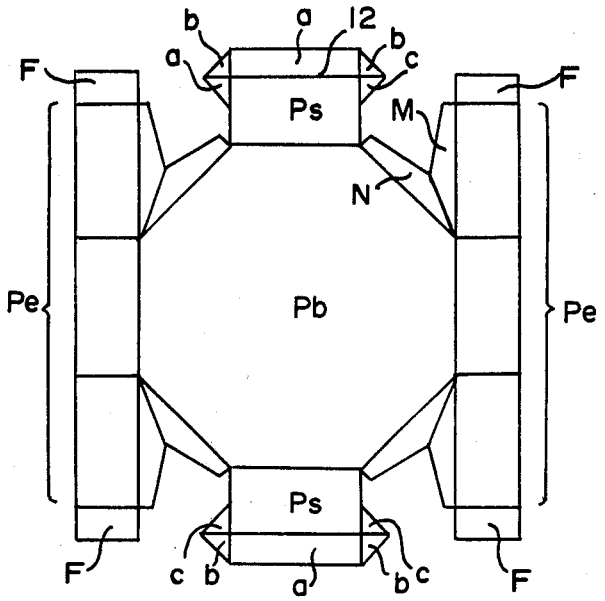
FIGS. 6A, 6B and 6C are views of the sixth embodiment in various states as in FIGS. 1A, 1B and 1C respectively.
Figure 6B:
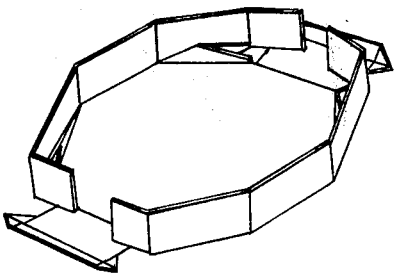
Figure 6C:
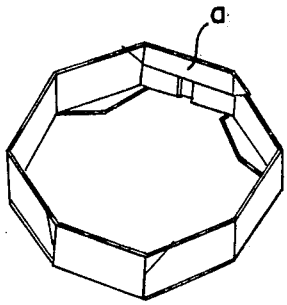

FIGS. 6A, 6B and 6C show a sixth embodiment which is another octagonal tray similar to the fifth embodiment except that the formation of the tabs T is the same as that of the third embodiment as shown in FIG. 3A, 3B and 3C. This embodiment illustrates an application of the tab proposed in the third embodiment to a polygonal tray made from a single cardboard blank.

Figure 7A:
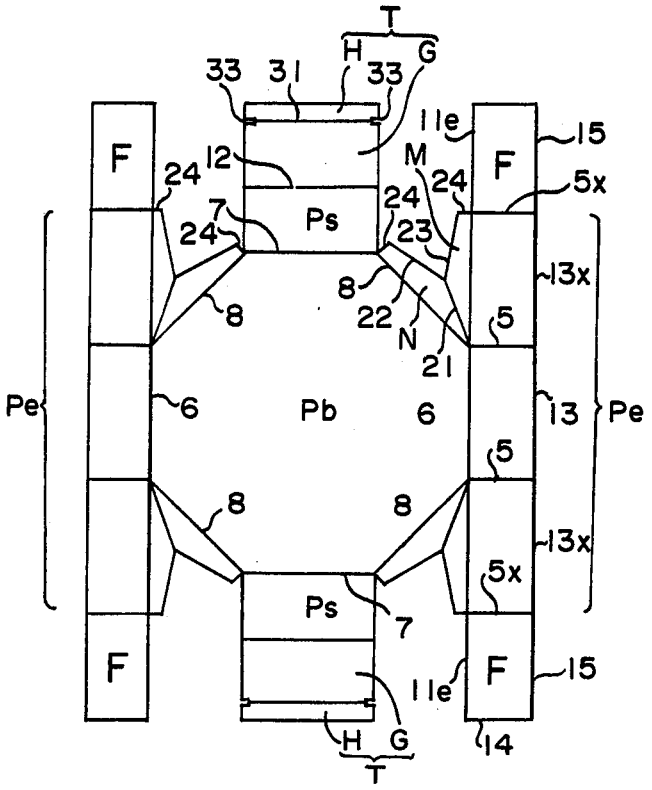
FIG. 7A, 7B and 7C are views of the seventh embodiment in various states as in FIGS. 1A, 1B and 1C respectively.
Figure 7B:
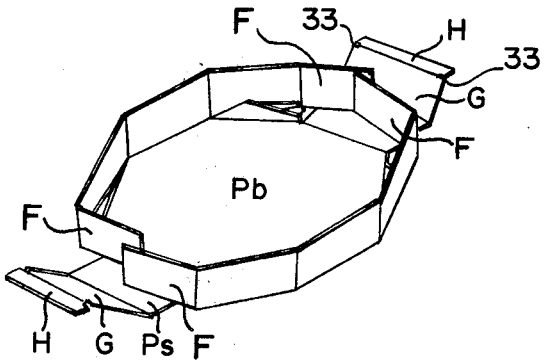
Figure 7C:
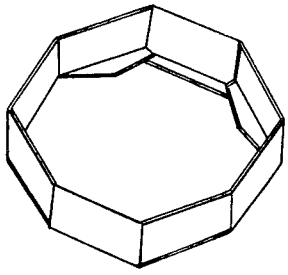

FIGS. 7A, 7B and 7C show a seventh embodiment which is yet another octagonal tray similar to the sixth embodiment except that the formation of the tabs T is different and the flaps formed at the ends of one of the side panels Pe overlap with the flaps of the opposite side panel Pe when the tray is made.

As shown in FIG. 7A, a side panel Ps of this embodiment is provided with a tab T comprising a main tab G of substantially the same dimensions as the side panel Ps and a lip H; between the main tab G and the lip H is a score line 31 having a notch 33 at each end. A score line 12 is formed between the side panel Ps and the main tab G.

The flaps formed at the ends of the side panels Pe are substantially of the same length as the side panel Ps. The formation of the bottom panel Pb, the side panel Pe and the connecting panel M and N is the same as in the sixth embodiment except that the small edges 24 formed on the connecting flaps M and N are of particular purpose of enfolding the end portions of the lip H to hold it in position when the tray is made.

The folding process for this embodiment is the same as in the sixth embodiment except that:

the side panels Ps are folded along the score lines 7 90 degrees upwardly to overlap with the two end flaps F folded to overlap each other with their bottom edges 11*e* substantially coinciding with the score line 7; the main tabs G are folded along the score lines 12 180 degrees inwardly over the edges 15 of the overlapping flaps F so that the score lines 31 meet the bottom edges 11 of the flaps F with the lips H folded along the score line 31 90 degrees in the opposite direction to be flush with the bottom surface of the tray. The ends of lips H are inserted in between the connecting flaps M and N that are folded inwardly to lie on the bottom surface of the tray, so that the flaps F are enfolded by the main tab G with the ends of the lips H enfolded by the folded connecting flaps M and N. The notches 33 formed at the ends of the score line 31 receive the edges 24 of the upper one of folded connecting flaps, which is M, to constitute locking engagement and secure the connection.

It will be apparent from the foregoing description that the present invention provides cardboard trays of various forms that are made from a single cardboard blank without additional material or equipment. It will be also apparent that the present invention renders saving of cost as the trays according to this invention can be delivered from the factory and stored in the blank form and made up for use at the packing counter without the need of additional facilities.

Although a number of preferred embodiments have been illustrated, further adaptions and modifications can be made without departing from the spirit and scope of the present invention as defined in the appended claims.

I claim:

1. A cardboard tray formed of a single blank suitably cut and scored, comprising:

a bottom panel;

two pairs of symmetrically opposed upfolding side panels formed around said bottom panel;

right triangular flaps formed on the sides of one pair of opposed side panels with the hypotenuse of the flap extending outwardly and upwardly from the corresponding side and one leg of said triangle being colinear with an outer edge of a corresponding side panel so the flaps can be folded inwardly to overlap the inner surface of the adjacent side panels;

tabs formed around the outer corners of the second pair of opposed side panels, each of said tabs forming three-quarters of a square with said outer corners forming the remaining quarter of each square, each tab being divided into said quarters by two score lines which extend diagonally across each tab to divide said tab into three equilateral triangles, each of said scorelines being colinear with one edge of said outer corner, one edge of said tab being parallel with and spaced from a hypotenuse of an adjacent flap so that each tab will fold first around the previously folded outer surface of the adjacent side panels and flaps, and second over the upper edge and theredown across the inner surface of the side panels and flaps;

said tabs thus enfolding both the outer and inner surface of the adjacent side panels and flaps; and a trapezoidal interim panel formed in between each side panel and said bottom panel, the non-parallel sides of adjacent interim panels being colinear with each other to form an edge extending between a tap and a flap at right angles to said tab and flap, said interim panels being folded flush with the bottom panel to form a flange around the bottom panel outside the side panels, said flange being provided with a polygonal notch formed on a mid-position of each side thereof.

2. An octagonal cardboard tray formed of a single blank suitably cut and scored, comprising a bottom panel, two pairs of symetrically opposed upfolding side panels; one pair of said side panels being of single panel folded form and connected to the bottom panel, and a second pair being of three panel sections connected end to end with the central panel section folded from and connected to the bottom panel; the end panel sections being inwardly folded along the end score lines of the central panel sections, the end panel sections being each provided with an end flap and a pair of infolding connecting flaps between the lower edge and the meeting side edge of the bottom panel, said end flaps being folded inwardly to overlap the inside surface of said single panels, said single panels each being provided with a tab having a lip parallel thereto, said tab being of same size as the single panel and folded inwardly over the flaps to abut on the inner side of said flaps, said lip being folded flush with the bottom panel with the end portions inserted in between the infolded connecting flaps; the score line along which said lip is folded being provided with notches at the ends to receive the edges of one of the infolded connecting flaps to form a locking engagement.

* * * * *